US008348719B2

(12) United States Patent
Lu et al.

(10) Patent No.: US 8,348,719 B2
(45) Date of Patent: Jan. 8, 2013

(54) POLISHER FOR CHEMICAL MECHANICAL PLANARIZATION

(75) Inventors: Hsin-Hsien Lu, Hsinchu (TW); Liang-Guang Chen, Hsinchu (TW); Tien-I Bao, Hsinchu (TW); Shau-Lin Shue, Hsinchu (TW)

(73) Assignee: Taiwan Semiconductor Manufacturing Co., Ltd., Hsin-Chu (TW)

( * ) Notice: Subject to any disclaimer, the term of this patent is extended or adjusted under 35 U.S.C. 154(b) by 1274 days.

(21) Appl. No.: 11/727,119

(22) Filed: Mar. 23, 2007

(65) Prior Publication Data

US 2008/0233839 A1 Sep. 25, 2008

(51) Int. Cl.

| | |
|---|---|
| ***B24B 49/00*** | (2012.01) |
| ***B24B 51/00*** | (2006.01) |
| ***B24B 1/00*** | (2006.01) |
| ***B24B 7/19*** | (2006.01) |
| ***B24B 7/30*** | (2006.01) |
| *C25F 3/30* | (2006.01) |

(52) U.S. Cl. ..... 451/41; 451/7; 451/53

(58) Field of Classification Search ..... 451/41, 451/7, 53

See application file for complete search history.

(56) References Cited

U.S. PATENT DOCUMENTS

| | | | | |
|---|---|---|---|---|
| 6,261,851 | B1 * | 7/2001 | Li et al. | 438/8 |
| 6,579,604 | B2 * | 6/2003 | Obeng et al. | 428/319.3 |
| 6,672,940 | B1 * | 1/2004 | Graham | 451/7 |
| 6,685,539 | B1 * | 2/2004 | Enomoto et al. | 451/41 |
| 6,818,301 | B2 * | 11/2004 | Obeng et al. | 428/411.1 |
| 7,153,191 | B2 * | 12/2006 | Naik | 451/8 |
| 2002/0189169 | A1 * | 12/2002 | Costas et al. | 51/307 |

* cited by examiner

*Primary Examiner* — Joseph J Hail
*Assistant Examiner* — Alvin Grant
(74) *Attorney, Agent, or Firm* — Birch, Stewart, Kolasch & Birch, LLP

(57) ABSTRACT

Embodiments of a polisher for chemical mechanical planarization. The polisher includes a polishing pad structure containing a first reactant therein, and a second reactant in a polishing environment over the polishing pad structure. The first reactant and the second reactant react endothermically upon contact when polishing a wafer surface between the polishing pad structure and the polishing environment.

23 Claims, 3 Drawing Sheets

POLISHER FOR CHEMICAL MECHANICAL PLANARIZATION

BACKGROUND OF THE INVENTION

1. Field of the Invention

The invention relates to a polisher for chemical mechanical planarization, and more particularly, to a polishing pad structure and a polishing environment thereof.

2. Description of the Related Art

Recently chemical/mechanical polishing (CMP) has been developed for providing smooth topographies. Parameters which affect the polish removal rate are downward pressure on the wafer, rotational speeds of the polishing platen and wafer carrier, slurry particle density and size, composition and temperature of slurry and polishing pad. Adjustment of these parameters permits control of the polishing and planarization processes; however, the problem of non-uniform polish removal rate continues to plague conventional CMP processes because, in general, removal rate is lower at an initial stage of CMP process or during a wet idle period due to high modulus of the polishing pad, and then gradually tend to be higher since the effect of raised temperature on friction during the CMP process causes low modulus of the polishing pad, as shown in FIG. 1.

One improvement in CMP to control uniformity is the use of cooling water underneath the polishing pad to control temperature thereof. However, extra facility modification of the polisher is required.

In U.S. Pat. No. 6,818,301, Yaw S. Obeng et al disclose a polishing pad structure utilizing the incorporation of filler particles into the polishing body, thereby enhancing its polishing characteristics in certain applications. The filler particles may include an anion comprised of hydroxide capable of decomposing to oxide and water during chemical-mechanical polishing, thereby enhancing polishing planarization. Moreover, such decomposition may be endothermic, thus providing an additional means of thermal management. Decomposition means a compound breaks down into two or more substances. However, the endothermic heat produced by the decomposition reaction may be not enough to balance the effect of the increased temperature from friction.

SUMMARY OF THE INVENTION

The invention is directed to a novel method and apparatus for controlling polish removal rate or uniformity of polish removal rate by way of endothermic reaction during chemical/mechanical planarization (CMP).

In accordance with exemplary embodiments, a polisher for chemical mechanical planarization comprises a polishing pad structure containing a first reactant therein, and a polishing agent and a second reactant in a polishing environment over the polishing pad structure. The first reactant and the second reactant react endothermically upon contact during polishing a wafer surface with the polishing agent and the polishing pad structure.

In accordance with exemplary embodiments, a polisher for chemical mechanical planarization comprises a polishing pad structure containing a first reactant therein, and a polishing agent and a second reactant in a polishing environment over the polishing pad structure. The first reactant and the second reactant react endothermically upon contact when a wafer surface is polished between the polishing pad structure and the polishing environment.

In accordance with exemplary embodiments, a polisher for chemical mechanical planarization comprises a polishing pad structure comprising a rotatable polishing platen, a soft based pad overlying the rotatable polishing platen, and a hard polishing pad containing a first reactant therein overlying the soft based pad. A chemical slurry supply system dispenses slurry containing a polishing agent and a second reactant onto the hard polishing pad to form a polishing environment over the polishing pad structure. A rotatable wafer carrier is adapted to hold a wafer and engage a wafer surface with the hard polishing pad. The first reactant and the second reactant react endothermically upon contact during polishing the wafer surface with the polishing agent and the hard polishing pad, thereby lowering a surface temperature of the hard polishing pad to adjust polishing removal rate of the wafer surface.

BRIEF DESCRIPTION OF THE DRAWINGS

The invention can be more fully understood by reading the subsequent detailed description in conjunction with the examples and references made to the accompanying drawings, wherein.

DETAILED DESCRIPTION OF THE INVENTION

Figure 1:
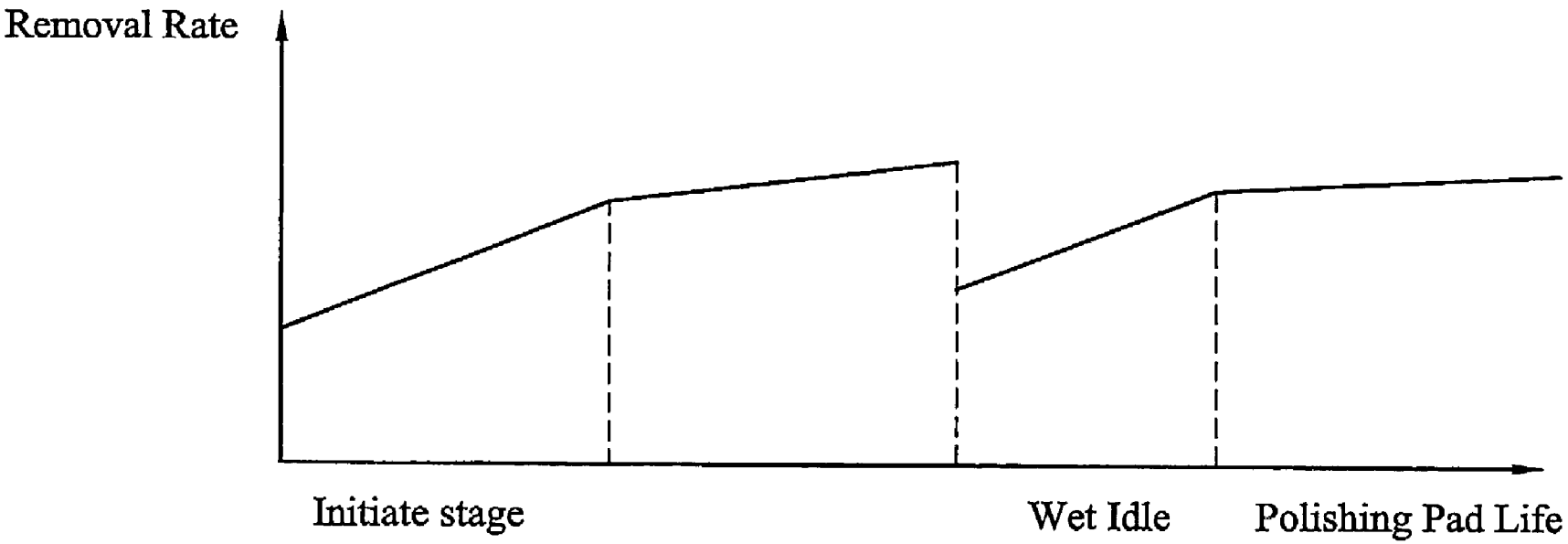
FIG. 1 ( PRIOR ART )
FIG. 1 is a graph illustrating the dependency of removal rates on the pad life for a chemical mechanical polishing pad.

Reference will now be made in detail to the present preferred embodiments of the invention, examples of which are illustrated in the accompanying drawings. Wherever possible, the same reference numbers are used in the drawings and the description to refer to the same or like parts.

Many components are utilized in the fabrication of semiconductor chips, such as device circuits, multi-level interconnections and insulating material. For example, shallow trench isolation in a substrate can be employed to isolate device circuits containing polysilicon layer, such as CMOS devices with poly gate electrodes. Multi-level interconnections, formed over the substrate, are typically metal or a conductor, such as Cu, W, or Al, and serve to electrically interconnect the discrete circuit devices. Interlevel dielectric (ILD) layers or intermetal dielectric (IMD) layers formed by, for example, chemical vapor deposition (CVD) of oxide, can be adapted to separate these interconnections.

The interconnections can be formed by various methods, such as by a single or dual damascene process in which trenches and via holes are etched in the ILD or IMD and filled with a metal. After completing the metal interconnections, a relatively thin barrier layer is deposited. Generally, the barrier layer is preferably composed of TaN or TiN.

As integration in semiconductor circuit chips increases, planarization of such layers becomes a critical step in the fabrication process. For example, technology requires that some surfaces of the insulating layers, such as STI, ILD, or IMD, be flat and thickness of the polished insulating layer be uniform across the semiconductor substrate. In such damascene processes, it is desirable that the metal interconnections have a smooth topography and that the barrier layers over thereof be removed.

Thus, a polisher for planarization procedure, such as CMP (chemical mechanical polishing), can be employed to remove layers to a predetermined depth and obtain a smooth topography.

Figure 2:
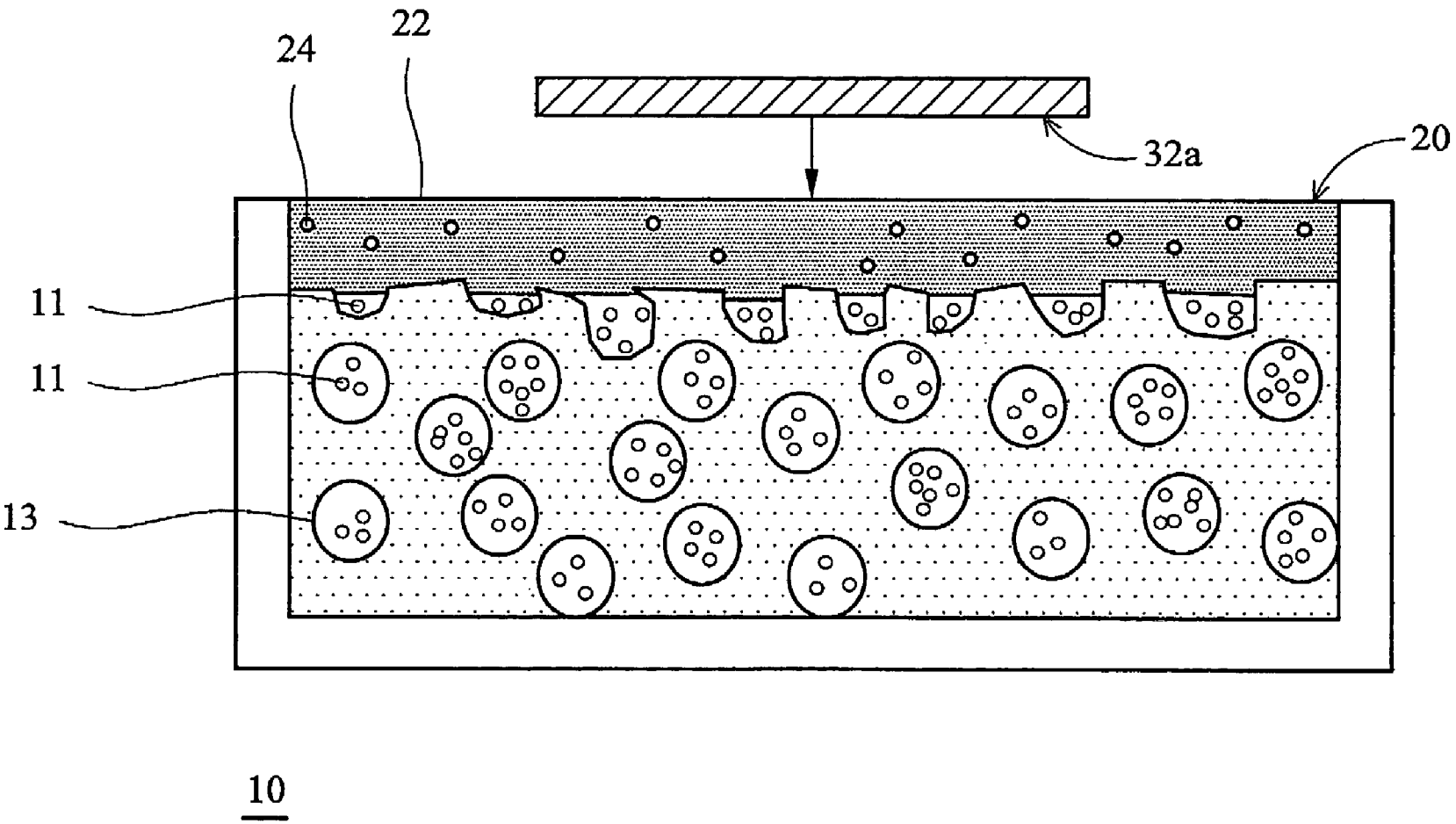
FIG. 2 is a sectional view of a polisher according to an exemplary embodiment of the invention.

FIG. 2 is a sectional view of a polisher 100 according to an exemplary embodiment.

A polishing pad structure 10 comprises a first reactant 11 therein, for example, embedded into micro holes 13 thereof. Over the polishing pad structure 10, a polishing environment 20 may comprise a polishing agent 22 and a second reactant 24. Specifically, the first reactant 11 and the second reactant 24 react endothermically upon contact when polishing a wafer surface 32*a* with the polishing agent 22 and the polishing pad structure 10. Typically, the wafer surface 32*a* is disposed between the polishing pad structure 10 and the polishing environment 20.

Figure 3:
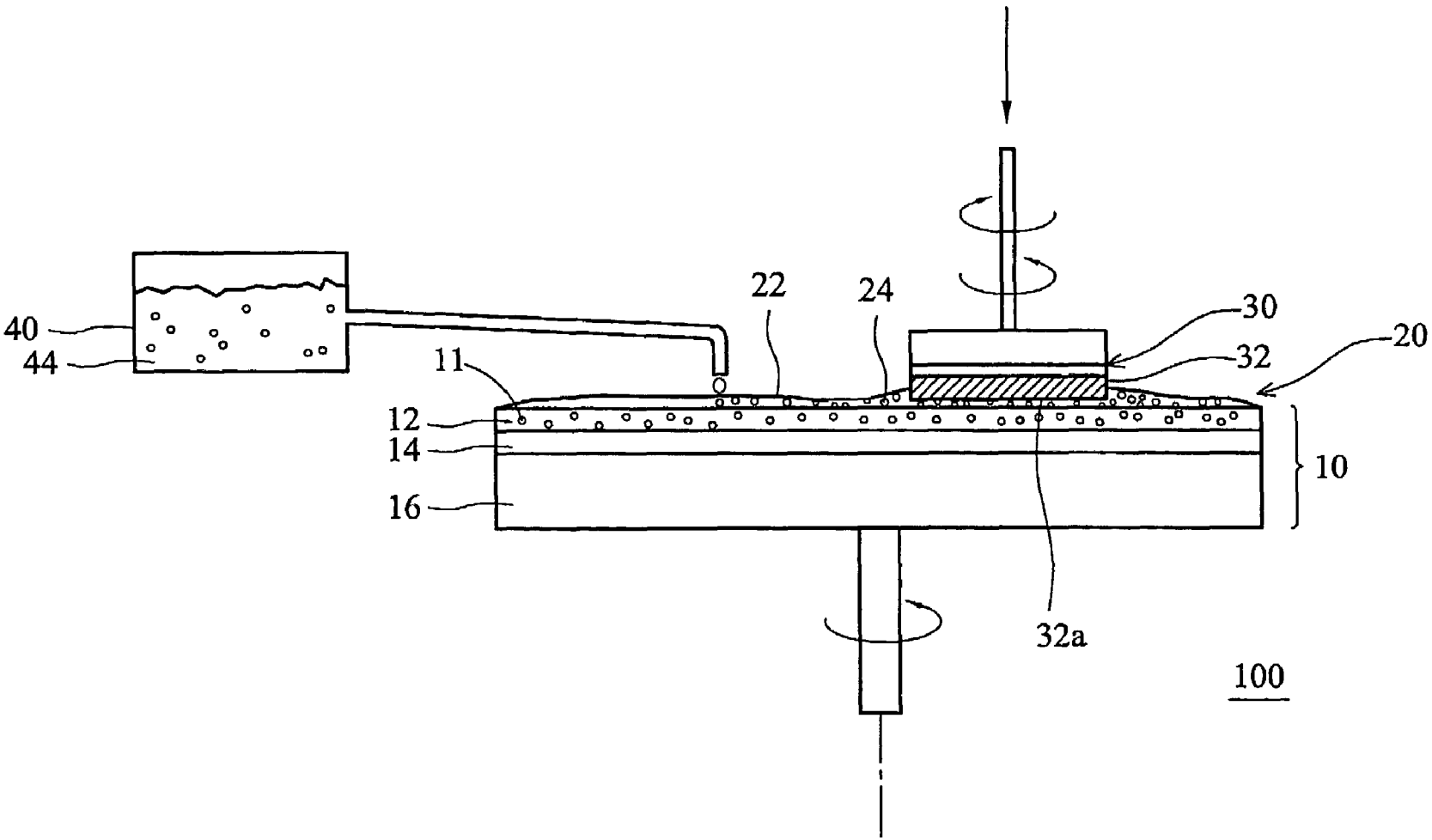
FIG. 3 is a sectional view of a polisher according to an exemplary embodiment of the invention.

In one example, as shown in FIG. 3, polishing pad structure 10 comprises a rotatable polishing platen 16, a soft based pad 14 overlying the polishing platen 16, and a hard polishing pad 12. Specifically, overlying the soft based pad 14, the hard polishing pad 12 of, for example, polymer material, contains a first reactant 11. Generally, the first reactant 11 is embedded into the micro holes 13 (as shown in FIG. 2) which are uniformly distributed in the hard polishing pad 12. A chemical slurry supply system 40 dispenses slurry 44 containing a polishing agent 22 and a second reactant 24 onto the hard polishing pad 12 to form a polishing environment 20 over the hard polishing pad 12.

A rotatable wafer carrier 30 is adapted to hold a wafer 32 to engage a wafer surface 32*a* with the hard polishing pad 12. The first reactant 11 and the second reactant 24 react endothermically upon contact when polishing the wafer surface 32*a* with the polishing agent 22 and the hard polishing pad 12. Thus, temperature of a polishing surface of the hard polishing pad 12, the polishing environment 20, or the wafer surface 32*a* is reduced enough to balance the effect of the temperature increase from friction, and subsequently provide uniformity of polishing removal rate thereof.

Preferably, the first reactant 11 and the second reactant 24 are inert and can react endothermically upon contact when polishing the wafer surface 32*a* to absorb heat from the polishing environment 20 and the polishing pad structure 10, and simultaneously produce an inert product without substantially influencing the chemical mechanical planarization process. Specifically, the first reactant 11, the second reactant 24, and the product are substantially inert to the slurry, the wafer surface 32*a* and the hard polishing pad 12.

As described, in some embodiments, double displacement reactions are applied to enhance the effect of endothermic heat reaction. In this type of reaction, an element. $M_aN_b$, from the first reactant 11 and an element $X_cY_d$ from the second reactant 24 can displace each other to form new products or compounds $M_aY_d$, $X_cN_b$. The reaction is:

$$M_aN_b+X_cY_d+\Delta H\rightarrow M_aY_d+X_cN_b$$

An example of a double displacement reaction occurs when utilizing barium-based material as the first reactant 11 and utilizing ammonia-based material as the second reactant 24. Specifically, the barium-based material may be barium hydroxide, barium hydroxide, or barium octahydrate, and the ammonia-based material may be ammonium thiocynate, ammonium nitrate, or ammonium chloride.

Another example of a double displacement reaction occurs when utilizing cobalt sulfate heptahydrate as the first reactant 11 and utilizing thionyl chloride ($SOCl_2$) as the second reactant 24.

Alternatively, an example of a double displacement reaction occurs when utilizing sodium carbonate as the first reactant 11 and utilizing ethanoic acid as the second reactant 24.

Further, an example of a double displacement reaction occurs when utilizing sodium bicarbonate as the first reactant 11 and utilizing citric acid solution as the second reactant 24.

Moreover, as described above, in some embodiments, the material of the first reactant 11 and the material of the second reactant 24 can replace each other.

EXAMPLE

In a polisher, the amount of slurry used on a hard polishing pad per wafer was about 100 ml and $NH_4NO_3$, a reactant, in the slurry was about 3 g (3%). Cutting rate of the hard polishing pad per wafer was about 2 um. Further, an area of the hard polishing pad 12 was about 5806 $cm^2$, and $Ba(OH)_2$, serving as another reactant, embedded into the micro holes occupied about 60 volume percent of the hard polishing pad. Thus $Ba(OH)_2$ was about 1.393 g per wafer and $NH_4NO_3$ about 3 g per wafer. The reaction was:

$$Ba(OH)_2+2NH_4NO_3+\Delta H\rightarrow 2NH_4+10H_2O+Ba(NO_3)$$

$\Delta H$=170 KJ/mole

After polishing the wafer surface with the slurry and the hard polishing pad, $Ba(OH)_2$ and $NH_4NO_3$ reacted endothermically upon contact and thus the temperature drop of the surface of the hard polishing pad was about 7.64° C.

Finally, while the invention has been described by way of example and in terms of preferred embodiment, it is to be understood that the invention is not limited thereto. On the contrary, it is intended to cover various modifications and similar arrangements as would be apparent to those skilled in the art. Therefore, the scope of the appended claims should be accorded the broadest interpretation so as to encompass all such modifications and similar arrangements.

What is claimed is:

1. A polisher for chemical mechanical planarization, comprising:

a polishing pad structure containing a first reactant therein; and a second reactant in a polishing environment over the polishing pad structure;

wherein the first reactant and the second reactant react endothermically upon contact when polishing a wafer surface between the polishing pad structure and the polishing environment.

2. The polisher according to claim 1, wherein the first reactant and the second reactant are substantially inert to the wafer surface, the polishing pad structure and the polishing environment.

3. The polisher according to claim 1, wherein the first reactant and the second reactant react to produce a product which is substantially inert to the wafer surface, the polishing pad structure and the polishing environment.

4. The polisher according to claim 1, wherein elements from the first reactant and the second reactant displace each other to form products or compounds during double displacement reactions.

5. The polisher according to claim 1, wherein one of the first reactant and the second reactant comprises barium-based material, and the other comprises ammonia-based material.

6. The polisher according to claim 5, wherein the barium-based material is barium hydroxide or barium octahydrate.

7. The polisher according to claim 5, wherein the ammonia-based material is ammonium thiocynate, ammonium nitrate, or ammonium chloride.

8. The polisher according to claim 1, wherein one of the first reactant and the second reactant comprises cobalt sulfate heptahydrate, and the other comprises thionyl chloride ($SOCl_2$).

9. The polisher according to claim 1, wherein one of the first reactant and the second reactant comprises sodium carbonate, and the other comprises ethanoic acid.

10. The polisher according to claim 1, wherein one of the first reactant and the second reactant comprises bicarbonate, and the other comprises citric acid solution.

11. A polisher for chemical mechanical planarization, comprising:

a polishing pad structure containing a first reactant therein; and a polishing agent and a second reactant in a polishing environment over the polishing pad structure;

wherein the first reactant and the second reactant react endothermically upon contact during polishing a wafer surface with the polishing agent and the polishing pad structure.

12. The polisher according to claim 11, wherein the first reactant and the second reactant are substantially inert to the wafer surface, the polishing pad structure and the polishing environment.

13. The polisher according to claim 11, wherein the first reactant and the second reactant react to produce a product which is substantially inert to the wafer surface, the polishing pad structure and the polishing environment.

14. The polisher according to claim 11, wherein elements from the first reactant and the second reactant displace each other to form products or compounds during double displacement reactions.

15. The polisher according to claim 11, wherein one of the first reactant and the second reactant comprises barium-based material, and the other comprises ammonia-based material.

16. The polisher according to claim 15, wherein the barium-based material is barium hydroxide or barium octahydrate.

17. The polisher according to claim 15, wherein the ammonia-based material is ammonium thiocynate, ammonium nitrate, or ammonium chloride.

18. The polisher according to claim 11, wherein one of the first reactant and the second reactant comprises cobalt sulfate heptahydrate, and the other comprises thionyl chloride ($SOCl_2$).

19. The polisher according to claim 11, wherein one of the first reactant and the second reactant comprises sodium carbonate, and the other comprises ethanoic acid.

20. The polisher according to claim 11, wherein one of the first reactant and the second reactant comprises bicarbonate, and the other comprises citric acid solution.

21. A polisher for chemical mechanical planarization, comprising:

a polishing pad structure, comprising:

a rotatable polishing platen, a soft based pad, overlying the rotatable polishing platen, and a hard polishing pad, containing a first reactant therein, overlying the soft based pad;

a chemical slurry supply system, dispensing a slurry containing a polishing agent and a second reactant onto the hard polishing pad to form a polishing environment over the polishing pad structure; and a rotatable wafer carrier, adapted to hold a wafer and engage a wafer surface with the hard polishing pad;

wherein the first reactant and the second reactant react endothermically upon contact during polishing the wafer surface with the polishing agent and the hard polishing pad, thereby lowering a surface temperature of the hard polishing pad to adjust removal rate of the wafer.

22. The polisher according to claim 21, wherein the first reactant and the second reactant are substantially inert to the wafer surface and the hard polishing pad.

23. The polisher according to claim 21, wherein the first reactant and the second reactant react to produce a product which is substantially inert to the wafer surface and the hard polishing pad.

* * * * *